United States Patent [19]

Ganz

[11] 4,332,200

[45] Jun. 1, 1982

[54] TAMPING DEVICE FOR RAILWAY TAMPING MACHINE

[75] Inventor: Jorg Ganz, Etoy, Switzerland

[73] Assignee: Sig Societe Industrielle Suisse, Switzerland

[21] Appl. No.: 169,802

[22] Filed: Jul. 17, 1980

[30] Foreign Application Priority Data

Aug. 3, 1979 [CH] Switzerland ..... 714379

[51] Int. Cl.[3] ..... E01B 27/16

[52] U.S. Cl. ..... 104/12; 184/6.12; 184/11 R

[58] Field of Search ..... 104/7 R, 7 B, 12, 10; 184/6.12, 11 R, 13 R

[56] References Cited

U.S. PATENT DOCUMENTS

| | | | |
|---|---|---|---|
| 504,063 | 8/1893 | Evans | 104/12 |
| 1,285,205 | 11/1918 | Johnson | 104/12 |
| 3,383,937 | 5/1968 | Toenne | 184/11 R X |
| 3,785,458 | 1/1974 | Caldwell et al. | 184/11 R X |
| 3,998,165 | 12/1976 | Jaeggi | 104/12 |
| 4,218,978 | 8/1980 | Pasquini | 104/12 |
| 4,240,352 | 12/1980 | Theurer | 104/12 |

FOREIGN PATENT DOCUMENTS

| | | | |
|---|---|---|---|
| 939119 | 2/1956 | Fed. Rep. of Germany | 184/11 R |
| 399504 | 9/1965 | Switzerland | 104/12 |
| 703616 | 12/1979 | U.S.S.R. | 104/12 |

*Primary Examiner*—Randolph A. Reese

*Attorney, Agent, or Firm*—Hedman, Casella, Gibson & Costigan

[57] ABSTRACT

A device comprising two pivoting tamping tools of lever form (9) which are mounted in opposition on a vertically movable housing (1).

Each tool (9) has a bearing (15) force-fitting on an eccentric surface of a rotary shaft (17) on which a regulating flywheel (19) having a peripheral toothing is fixed within the housing (1).

The two flywheels (19) engage with each other via their toothing and one of them also meshes with a pinion (22) which is driven by a motor (21).

The pivoting of the two tools (9) is controlled, in phase opposition, by two cylinder-piston units (12).

A lubricating circuit, driven as a result of the stirring of a bath of oil by the flywheels (19) and of centrifuging by an imbalance weight, is established through the bearings of the rotary shaft (17).

8 Claims, 5 Drawing Figures

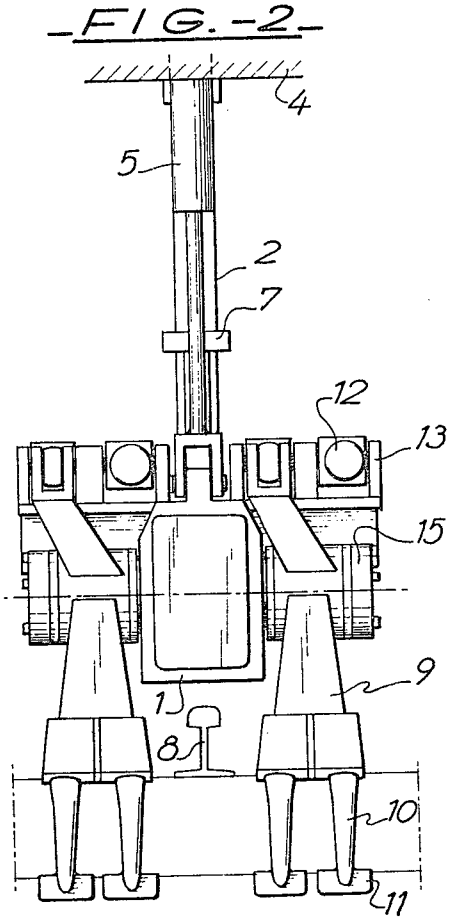
-FIG. -2-
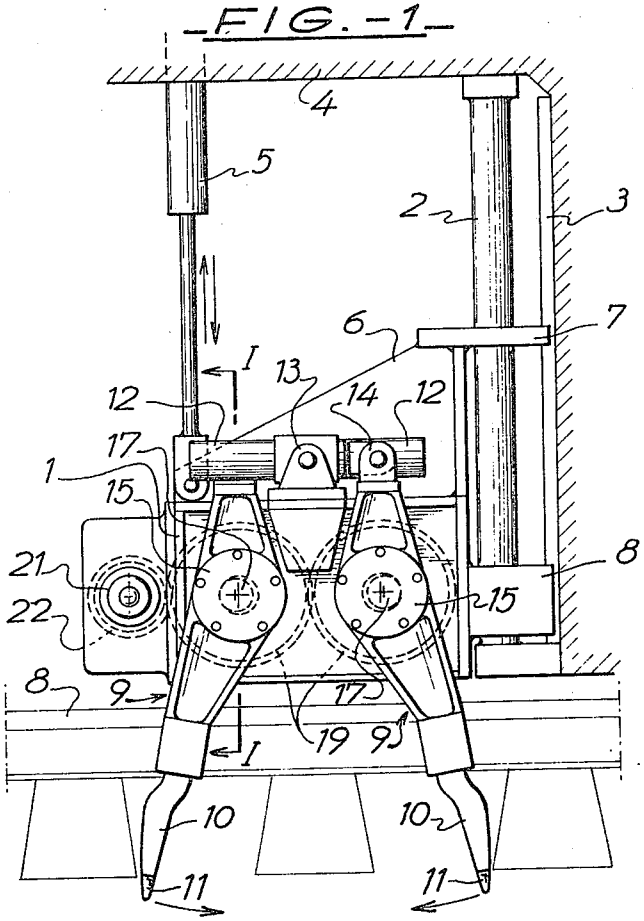
-FIG. -1-

TAMPING DEVICE FOR RAILWAY TAMPING MACHINE

The object of the present invention is a tamping device for a railway tamping machine which is intended for the compacting by compressing and vibration of the ballast below the railway ties and the ends of the tools of which are imparted vibrations of elliptical trajectory so as to facilitate their penetration into the ballast.

This specific type of vibration imparted to the tamping tools is already known but has not given rise, in consistent manner, to concrete embodiments due to the difficulties encountered in the use thereof, which result to the greatest extent from the fact that it creates the necessity of placing the articulation of the tamping tools in vibration.

An embodiment has been proposed in which this effect is obtained by mounting the pivot pin of the tamping tool in a sleeve with eccentric borehole, which in its turn is turnably mounted within a concentric bearing fastened to the housing of the device. In this construction, the pivot pin of the tool is fixed with respect to the latter and it is the sleeve with eccentric borehole which is driven in rotation, via a notched belt transmission or a gear train, by an offset drive shaft on which, outside the housing, an inertia flywheel is mounted in order to make the said rotation uniform.

This structure is complicated and gives rise to alternate variations in the stresses which act on the transmission of the movement of rotation which connects the drive shaft to the sleeve with eccentric borehole, as a result of the fact that this transmission must absorb a large portion of the resistance opposed by the ballast to the turning, vibratory movements of the tools, and it raises problems as to lubrication, due to the number and dispersion of the parts to be lubricated.

The tamping device in accordance with the invention is of simpler construction and provides a solution for the aforesaid problems. It makes it possible:

- to avoid the concentric duplication of sleeve and articulation bearing of the tools;
- substantially to decrease the alternate stresses in the transmission of the movement of rotation to the articulations of the tools since the flywheel which regulates this rotation is directly mounted on the eccentric shaft which generates these stresses; and
- to mount this regulating flywheel within the housing itself, which simplifies the lubricating problems.

The accompanying drawing shows, by way of example, one embodiment of the object of the invention.

FIG. 1 is a view in elevation thereof.

FIG. 2 is a side view.

Figure 3:
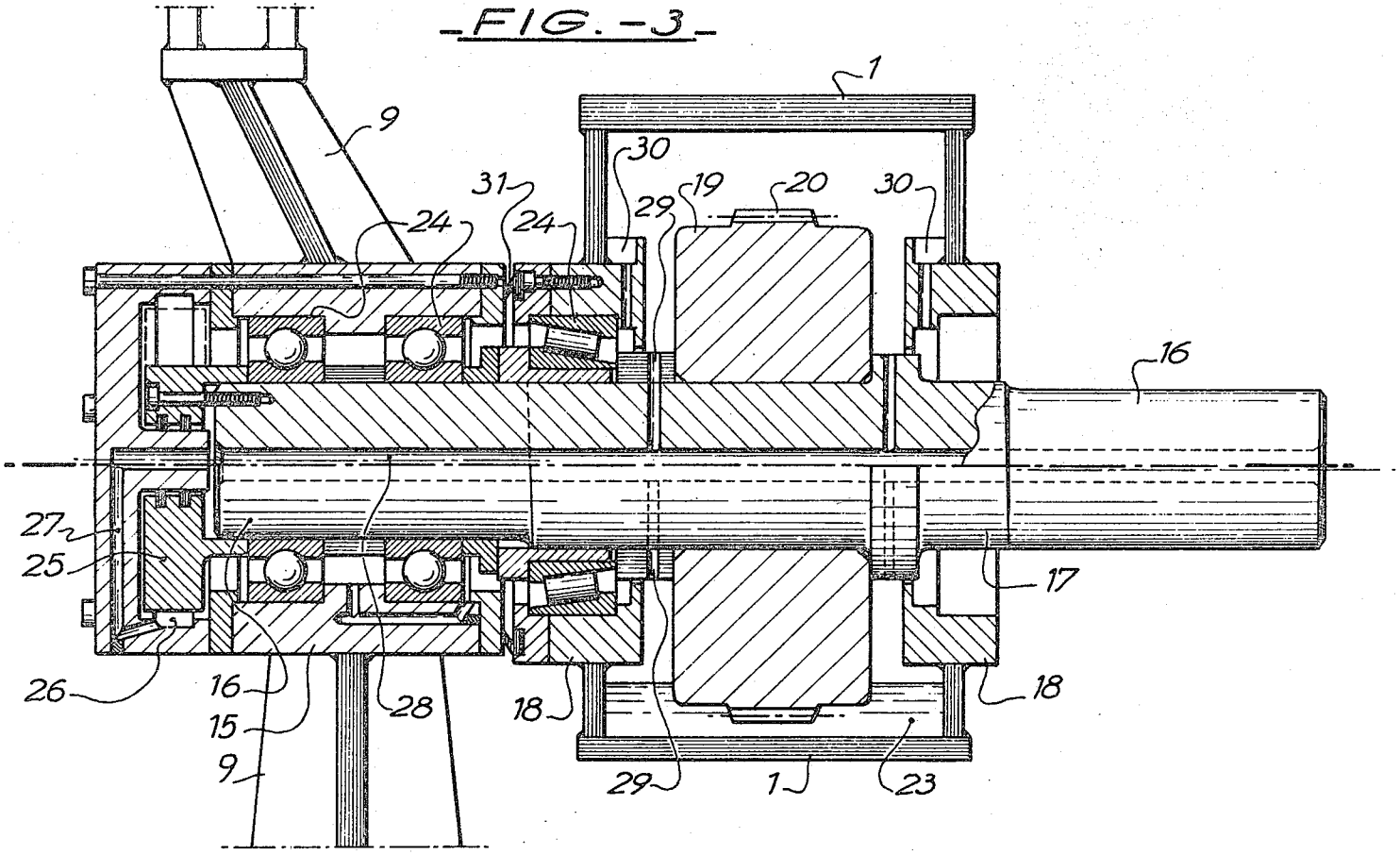
FIG. 3 is a partial section, on a larger scale, along the section line I—I of FIG. 1.

The tamping device shown comprises a vertically movable housing 1 whose displacements are guided by a column 2 and a slideway 3 intended to be fastened to the chassis 4 of a railway tamping machine, the displacement being produced by a piston-cylinder unit 5, also fastened to the said chassis. The housing 1 is connected to the column 2 and to the slideway 3 by a triangulated structure 6 having two bearings 7 and 8 in engagement with these two guide elements.

On the housing 1, which is arranged above a line of rails 8, there are articulated, mounted in opposition, on each side of the said line of rails, two lever-shaped pivoting tamping tools 9, to the bottom of which there are fastened picks (10) provided with end pieces 11.

The tamping tools shown are articulated to the housing 1 at their central portion and their pivoting movements are produced, in phase opposition, by two cylinder-piston units 12, the cylinder of which is articulated in a yoke 13 fastened to the housing 1 and the piston rod of which is articulated in a strap 14 fastened to the upper part of the tools 9.

Each tool 9 has an articulation bearing 15 forcefitted on an offset outer surface 16 (FIG. 3) of a shaft 17, mounted for rotation in two bearings 18 fastened to the side walls of the housing 1. Within the housing 1 an inertia flywheel 19 having a peripheral drive-toothing 20 is fastened on the shaft 17.

The two flywheels 19 of the two pivot shafts 17 of the tools 9 mounted in this manner are connected by their toothings 20, as shown in dash line in FIG. 1, and one of these two flywheels 19 is driven in rotation by a motor 21, on the output shaft of which there is mounted a pinion 22 whose toothing meshes with that of the said flywheel within the housing 1.

This structure lends itself readily to the installation of a lubrication circuit fed by a lubricating liquid bath 23 formed at the bottom of the housing 1 and into which the toothing 20 of the flywheels 19 dips. The details of a particular installation intended for this purpose are shown in FIG. 3.

In this arrangement, the pivot bearing 15 of each tool 9 and the bearings 18 bearing the shaft 17 are ball bearings 24 (FIG. 3) and the shaft 17 has a balance weight 25 mounted enclosed in a chamber 26 of the bearing 15.

The chamber 26 communicates via a radial conduit 27 with an axial conduit 28 in the shaft 17, which conduit in its turn debouches within the housing 1 via radial conduits 29.

On the upper and inner parts of the housing 1 there are mounted cups 30 which debouch via a conduit into the housing of the ball bearings 24 (FIG. 3) of the bearings 18. This housing then communicates with that of the ball bearings of the articulation bearing 15 of the tools 9, which in its turn communicates with the chamber 26.

An annular joint 31, arranged between these two bearings 18 and 15, assures tightness of the circuit thus constituted through the ball bearings 24.

In operation, the lubricating liquid of the bath 23, stirred by the flywheels 19, is sprayed and projected onto the walls of the housing. One part returns to the bath and the other part is recovered in the cups 30, passes through the ball bearings 24 (FIG. 3) of the two bearings 18 and 15, and arrives into the chamber 26 in which it is centrifuged onto the cover of said chamber by the balance weight 25 and delivered through the radial conduit 27 into the axial conduit 28 of the shaft 17, which returns it to the bath 23 via its radial conduits 29.

This manner of lubrication, which is advantageous in view of its simplicity and reliability, is made possible by the direct mounting of the inertia flywheel 19 on the pivot shaft 17 of the tamping tools within the housing 1, which makes it possible to assure, in the best possible manner, by the annular joint 31 alone the tightness of the enclosure within which the lubrication circuit is established.

Variant constructions can be employed.

The tool holders 9 may be designed as a different type of lever, for instance articulated at their upper end to the offset-surface shaft 17 and moved at their central portion by the cylinder-piston units 12, the vertical position of these elements being reversed.

The rotary drive of the articulation shafts 17 of the tools 9 may be designed differently.

Figure 4:
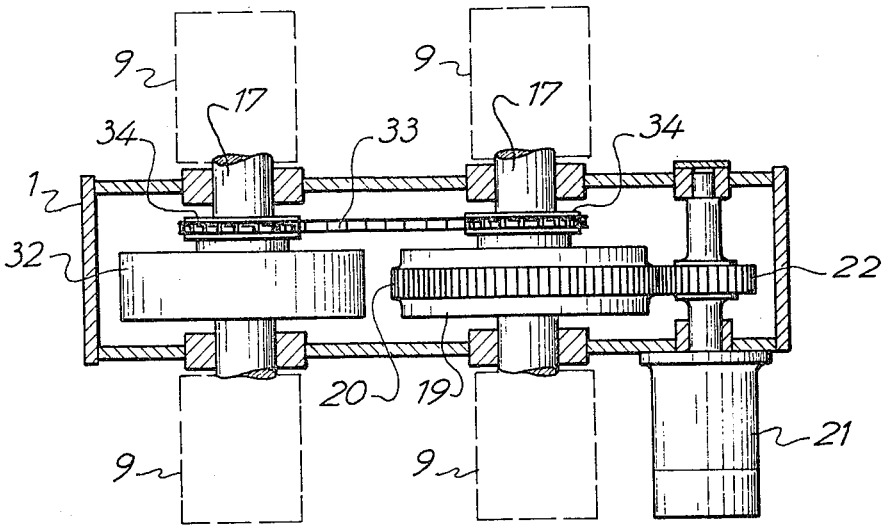
FIGS. 4 and 5 are two diagrammatic showings in partial section of two variants of details of construction.
Figure 5:
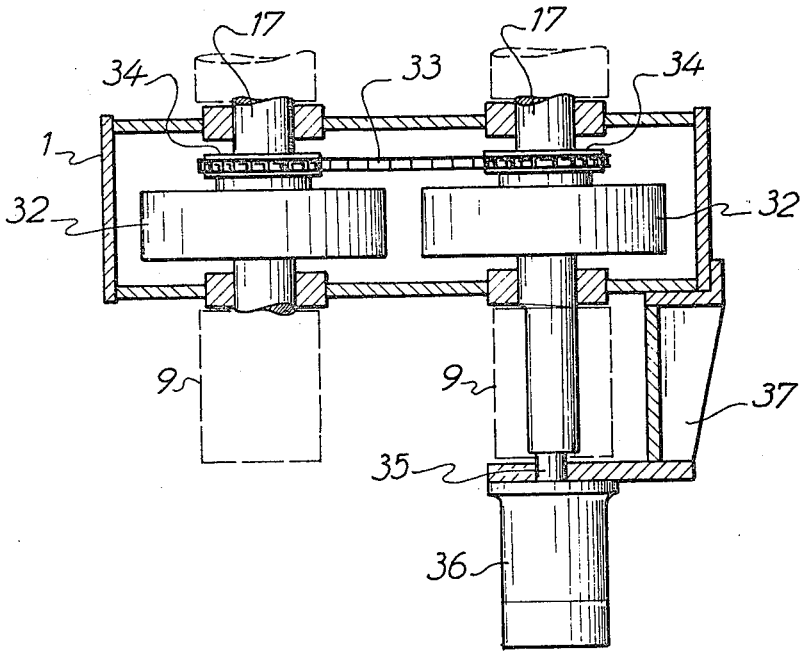

FIGS. 4 and 5 show two variants of this drive, shown in simplified and diagrammatic manner in partial cross section along a sectional plane passing through the axis of these two shafts 17.

In FIG. 4, a single flywheel 19 has a toothing 20 meshing with the pinion 22 of the motor 21. The second flywheel 32 of the second tool 9 is driven in rotation by a chain transmission 33 connecting two pinions 34 which are rigidly connected with the two flywheels 19 and 32.

This variant will be used to impart the two shafts 17 movements of rotation in the same direction when this effect is desired. It may also comprise, for each tool articulation, a lubrication circuit similar to the one which has been described previously and shown in FIG. 3.

The variant shown in FIG. 5 is also applicable in order to impart the two shafts 17 movements of rotation in the same direction, neither of the flywheels, both marked 32, being provided with teeth. One of the two shafts 17 has an axial extension 35 driven directly by a motor 36 which is supported by a bracket 37 fastened to the housing 1 and surrounding the tool 9 which is articulated on said shaft. The two flywheels 32 are connected by a transmission consisting of chain 33 and pinions 34, as in the preceding variant.

In this second variant, which makes it possible to limit the lateral size of the housing 1, the articulation of the tool 9 in front of which the motor 36 is mounted is lubricated by means different from the lubricating circuit shown in FIG. 3 because of the emergence of the extension 35 of this shaft from the bearing of said tool, for instance by means of a circuit under pressure. The other articulations, on the other hand, can be equipped with this circuit.

Finally, this type of direct drive of one of the two articulation shafts 17 of the tools 9 can be applied to the embodiment shown by way of example in FIGS. 1 to 3, that is to say that in which the two inertia flywheels are toothed and engage with each other via their toothings.

What is claimed is:

1. A tamping device for railway track tampers, comprising:

(a) a vertically movable housing;

(b) at least two parallel shafts rotatably mounted in said housing, each of said shafts having at least one end portion extending out of said housing, said end portion being eccentric;

(c) at least two pivoting substantially rectilinear lever-shaped tamping tools, each having an end blade at its lower end, each of said tamping tools being respectively and pivotally mounted on said outer eccentric end portion of one of said shafts;

(d) two double acting jacking assembly means extending in a substantially horizontal direction and respectively articulated to said housing and to said tamping tools for pivoting said two tamping tools in phase opposition;

(e) an inertia flywheel fastened on each of said shafts inside said housing; and (f) motor means for driving said shafts into rotation, whereby a vibration of elliptical trajectory is imparted to the end blade of each tamping tool.

2. A tamping device according to claim 1, wherein the inertia flywheel of one of said shafts has a peripheral drive toothing, and wherein the inertia flywheel of the other shaft is driven by a chain transmission connecting both flywheels.

3. A tamping device according to claim 2, wherein said motor means comprise an output pinion, and wherein said peripherally toothed flywheel meshes with said output pinion.

4. A tamping device according to claim 2, wherein the shaft which bears the peripherally toothed flywheel is driven coaxially by said motor means.

5. A tamping device according to claim 1, wherein the inertia flywheels of both said shafts have a peripheral drive toothing, and wherein said flywheels mesh with each other via their peripheral toothing.

6. A tamping device according to claim 5, wherein said motor means comprise an output pinion, and wherein one of said peripherally toothed flywheels meshes with said output pinion.

7. A tamping device according to claim 5, wherein the shaft bearing one of said peripherally toothed flywheels is driven coaxially by said motor means.

8. A tamping device according to claim 1, wherein the inertia flywheels of both said shafts are connected to each other by a chain transmission, and wherein the shaft bearing one of them is driven coaxially by said motor means.

* * * * *